US009754775B2

(12) United States Patent
Seedorf et al.

(10) Patent No.: US 9,754,775 B2
(45) Date of Patent: Sep. 5, 2017

(54) ADJUSTMENT MECHANISM

(71) Applicant: Thermo Fisher Scientific (Bremen) GmbH, Bremen (DE)

(72) Inventors: Silke Seedorf, Weyhe (DE); Michael Krummen, Bad Zwischenahn (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/962,946

(22) Filed: Dec. 8, 2015

(65) Prior Publication Data

US 2016/0172090 A1 Jun. 16, 2016

(30) Foreign Application Priority Data

Dec. 12, 2014 (GB) ..... 1422192.3

(51) Int. Cl.
*H01F 7/02* (2006.01)
*H01J 49/24* (2006.01)
*H01J 49/04* (2006.01)

(52) U.S. Cl.
CPC ..... *H01J 49/24* (2013.01); *H01F 7/0242* (2013.01); *H01J 49/04* (2013.01)

(58) Field of Classification Search
CPC ..... H01F 7/0242; H01J 49/04; H01J 49/26–49/4295
See application file for complete search history.

(56) References Cited

U.S. PATENT DOCUMENTS 5,376,862 A * 12/1994 Stevens ..... H02K 49/106 310/103
5,886,608 A * 3/1999 Chabay ..... A63H 33/26 310/1
6,291,802 B1 9/2001 Ford

FOREIGN PATENT DOCUMENTS

CN 102589999 A 7/2012
GB 1185085 A 3/1970
JP S60-6373 A 1/1985

OTHER PUBLICATIONS

Thomas, "Structure determination of thin polymer films using-GIXRD and AFM", 2010, Cardiff University, Chpt. 3, pp. 36-48. Available from http://orca.cf.ac.uk/55063/1/U585452.pdf.

* cited by examiner

*Primary Examiner* — Ramon M Barrera
(74) *Attorney, Agent, or Firm* — David A. Schell

(57) ABSTRACT

A magnetic adjustment mechanism 100 comprising a chamber 10, an element 12 pivotally mounted within the chamber 10 and comprising a magnetic portion 14, and a magnetic actuator 18 arranged outside the chamber 10 to allow magnetic coupling with the magnetic portion 14 of the element 12 such that movement of the magnetic actuator 18 causes an adjustment of the position of the element 12. The adjustment mechanism 100 may be used within a vacuum chamber of a mass spectrometer to control the position of a moveable element from outside the chamber.

16 Claims, 5 Drawing Sheets

ADJUSTMENT MECHANISM

FIELD OF THE INVENTION

The invention relates to an adjustment mechanism for adjustment of an element within a chamber. Particularly, the mechanism allows for adjustment of an element within a chamber from outside the chamber. The invention may be particularly beneficial for adjustment of the width of an aperture within a vacuum chamber of a mass spectrometer.

BACKGROUND TO THE INVENTION

Various scientific instruments comprise pressurized chambers, either containing regions of low or high pressure, or containing a vacuum. In order to adjust or move one or more components in the chamber, an actuator can be used to apply a force to move the component. Known adjustment mechanisms make use of actuators comprising, for example, threaded rods, or thermoelectric or piezoelectric elements. These types of adjustment mechanisms have the disadvantage that at least a portion of the actuator or a connection to the actuator must be provided at sealed feedthroughs in the wall of the chamber. This both increases complexity and increases the likelihood of leakage of the pressurized chamber.

Spectrometers, especially mass spectrometers, require an ion beam path to pass through a slit or aperture within a vacuum chamber. It is useful to be able to select the width or dimensions of the slit or aperture, depending on the requirements for maximum sensitivity or maximum resolution of the measurement. In order to provide a variety of aperture dimensions for use in the mass spectrometer, an aperture plate is included which comprises multiple apertures of different dimensions. The aperture plate can be moved within the vacuum chamber for alignment of the chosen aperture with the ion beam. As it is not desirable or practical to open the vacuum chamber to move the aperture plate, an adjustment mechanism is required which can be operated from outside the chamber.

U.S. Pat. No. 5,451,780 describes a device for setting slit widths in the beam path of spectrometers. The device uses a lever which is pivotally connected within the vacuum chamber, and which has slits of different dimensions at one end of the lever. A Bourdon tube is connected to the opposite end of the lever furthest from the slits. When the pressure in the Bourdon tube is increased, the lever is rotated around the pivot to cause a different aperture to be bought into alignment with the ion beam. The connection to the Bourdon tube is required through the wall of the vacuum chamber.

The known adjustment mechanisms each require connection to an actuator through the walls of the chamber. As such, these connections must be correctly sealed and maintained in order to prevent leaks to the chamber.

In view of the above, there is a need to provide an improved adjustment mechanism for effecting adjustment of a moveable element inside a sealed or closed chamber.

SUMMARY OF THE INVENTION

Against this background, there is provided a magnetic adjustment mechanism which uses a magnetic actuator outside a chamber to magnetically interact with a magnetic portion of a moveable element within the chamber. Subsequent movement of the magnetic actuator causes movement of the element within the chamber. Advantageously, the mechanism does not require any portion of the actuator to extend through the walls of the chamber. This is especially useful when the chamber is a pressurized chamber.

According to a first aspect of the invention, there is provided a magnetic adjustment mechanism comprising: a chamber; an element comprising a magnetic portion, the element pivotally mounted within the chamber; and a magnetic actuator arranged outside the chamber to allow magnetic coupling with the magnetic portion of the element, such that movement of the magnetic actuator causes an adjustment of the position of the element. For example, the magnetic actuator is arranged outside the chamber, proximate to the magnetic portion of the element inside the chamber. The magnetic actuator couples to the element using magnetic interaction. When the magnetic actuator is moved, this drags or tows the magnetic portion thereby causing the element to rotate around the pivot. Advantageously, the actuator is arranged outside the chamber, and does not require any entry port or other feed-through for the magnetic actuator into the chamber. In other words, the magnetic actuator acts remotely from the element to be adjusted, without direct connection between the element and the magnetic actuator.

Optionally, the chamber is a pressure chamber. For example, the chamber may contain a pressure greater than atmospheric pressure (or high pressure) or less that atmospheric pressure (or low pressure). The pressure chamber may be a vacuum chamber. The magnetic adjustment mechanism is particularly advantageous for use when the element must be housed in a pressurised container or vacuum chamber, as the actuator operates without direct contact with the element. Furthermore, the invention may be especially useful in ultra-high vacuum applications which require permanent or semi-permanent sealing of the chamber. This is because the magnetic actuator of the adjustment mechanism acts remotely from the element, and so no part of the adjustment mechanism extends through the walls of the chamber. Thus, the need to provide an ultra-high vacuum tight seal at a feedthrough for any portion of the adjustment mechanism is avoided.

Preferably, the magnetic portion of the element comprises a material that can be temporarily magnetised. In other words the magnetic portion comprises material which is a temporary magnet. Suitable materials include ferromagnetic materials which become magnetised when placed in an external magnetic field, but which are no longer magnetised when moved outside of a magnetic field. For example, the magnetic portion may be a soft metal piece. Alternatively, the magnetic portion may comprise a permanently magnetised material, in which the magnetic field persists whether or not it is in the presence of an external magnetic field.

Preferably, the magnetisable portion is formed of iron. Iron having the highest possible purity is preferred. This material can be temporarily magnetised, but does not have a persistent magnetic field when removed from the presence of an external magnetic field. Ideally, the purity will be at least greater than 95% iron. For example, the magnetic portion may be formed of ARMCO™ which has a purity of 99.8% to 99.9%. Alternatively TRAFOPERM™ could be used, which comprises at least 97% iron together with 3% of silicon and/or molybdenum.

Preferably, the magnetic portion is confined to a region of the element. For example, the magnetic portion may be integral to the body of the element, and confined only to a portion of the body. Alternatively, the magnetic portion may be a separate piece that is attached the element.

Advantageously, the magnetic portion is confined to a region of the element positioned distal from the pivotable mount. For example, the magnetic portion may reside at the opposite end of the element to an end that is connected to the pivot. Beneficially, this increases the distance between the pivot and the point at which the force is applied by the actuator. Therefore, the force required to move or rotate the element around the pivot is reduced.

Ideally, the movement of the magnetic actuator between a first and a second location causes the position of the element to be adjusted between a first position and a second position. In other words, the actuator is arranged to move between a start location and an end location, and as a result the element within the chamber is switched between a corresponding first and second position. This allows the position of the element to be selectively adjusted between the first and second position.

Optionally, a first and a second end stop may be arranged to restrict the extent of the adjustment or rotation of the element, the first and second end stop arranged to permit adjustment of the element only between the first and second position. Advantageously, the first and second end stops provide a buffer to ensure that the element does not move past the first or second position. Therefore, the first and second end stop may be beneficial where precise alignment of the element in the first and second position is required. Furthermore, the first and second end stop may be arranged such that the weight of the element causes the element to rest against the first or second end stop in the event that the magnetic coupling with the actuator is removed. In this situation, the element may rest against the end stop simply as a consequence of its own weight. In some configurations, only one end stop may be provided, or the end stops may be provided by the wall of the chamber. The end stops are particularly important for applications of the adjustment mechanism where precise alignment of the element in the first or second position is required.

Optionally, the first and/or second end stops may be adjustable. In other words, they may be configured to be moveable and thereby allow for variation of the first and second positions (or end positions) of the element. For example, the end stops may be threaded screws which can be moved relative to a complimentary nut fixed at the chamber wall. The element may rest against an end of the screw when in the first and second position. Therefore, the adjustable end stops may be configured such that turning the screws into and out of the nut allows for small adjustments in the first and second position of the element. Beneficially, this allows the first and second position of the element to be set very precisely.

Preferably, a magnetic shielding element is arranged between the magnetic portion of the element and the magnetic actuator when the magnetic actuator is the first location and/or arranged between the magnetic portion of the element and the magnetic actuator when the magnetic actuator is in the second location. In this configuration, the magnetic shielding element shields the magnetic portion of the element from the magnetic field of the magnetic actuator when the magnetic actuator is at the first or second location. The first and second location may be a start and end location for the actuator. If the magnetic portion of the element comprises temporary magnetic material, the magnetic shielding element prevents the magnetic portion from being magnetised. This is because the magnetic shielding element provides a shield or barrier to the magnetic field of the magnetic actuator. Beneficially, this configuration avoids a magnetised component being present in the chamber. As such, the configuration is particularly useful in a mass spectrometer where a magnetised component could affect the ion beam.

Preferably, the magnetic shielding element is arranged to shield both the magnetic portion and the interior of the chamber from the magnetic field of the magnetic actuator when the magnetic actuator is in the first location and/or in the second location. Therefore, the magnetic shielding element may be positioned between the magnetic actuator and chamber, such that, when the magnetic actuator is at its first and second (or end) locations, the magnetic field of the magnetic actuator is prevented from extending into the chamber. This may be particularly beneficial in a mass spectrometer where a magnetic field may deflect or otherwise effect an ion beam passing through the chamber.

Optionally, the magnetic shielding element may be arranged to at least partially surround the magnetic actuator when the magnetic actuator is in the first position and/or in the second position. Alternatively, the magnetic shielding element may be arranged to enclose the magnetic actuator when the magnetic shielding element is in the first position and/or in the second position. In other words, the magnetic shield may form an enclosure around the magnetic actuator, or may be a tubular shape which encircles or houses the actuator. Otherwise, the magnetic shielding element may be a curved plate (for example, a "C" or "U" shape), or could be a planar shape. In any case, the shield is arranged to block the magnetic field of the magnetic actuator from the magnetic portion of the element.

Preferably, the magnetic shielding element is formed of a material which can be temporarily magnetised. This allows the magnetic shielding element to shield the magnetic field of the magnetic actuator. For example, pure iron could be used to form the magnetic shield, as this becomes magnetised only in the presence of an external magnetic field. Ideally, the highest possible purity of iron may be used. For example, ARMCO™ or TRAFOPERM™ having a purity of upwards of 99.8% or 97% respectively could be used. In some embodiments, a nickel-iron alloy such as mu-metal could be used.

Advantageously, the element comprises a plate having one or more apertures and wherein adjustment of the position of the element results in selection of an aperture. For example, the element may be a plate comprising a first aperture or slit having a narrow width, and a second aperture or slit having a wider slit. Alternatively, the first and second aperture could comprise circular apertures of differing diameter, or apertures of another shape and dimensions. The element may be arranged with respect to an opening in the chamber wall, such that a first aperture is aligned with the opening when the element is in the first position, and the second aperture is aligned with the opening when the element is in the second position.

The described magnetic adjustment mechanism is particularly beneficial when arranged in the vacuum chamber of a mass spectrometer. The magnetic adjustment mechanism can be used to move a component of the mass spectrometer (e.g. an ion optical component) in relation to an ion beam path in the vacuum chamber of the mass spectrometer. The component can be, for example, an aperture (through which the ion beam passes), or ion beam stop, or shutter, or electrode, or lens, or detector, etc. The component can be fixed to the element or formed integrally with the element whereby adjustment of the position of the element causes movement of the component. In a preferred embodiment, the magnetic adjustment mechanism can be used to select an aperture through which an ion beam is passed. For this purpose, the use of a magnetisable magnetic portion and the magnetic shielding element, as described herein, may be particularly desirable. This is because provision of a permanently magnetised component within the mass spectrometer may deflect the ion beam passing through the mass spectrometer. As such, when the described adjustment mechanism is used in a mass spectrometer, the magnetic shield may preferably be arranged to shield both the magnetic portion of the element or aperture plate and the ion beam passing within the chamber.

Preferably, the one or more apertures have different dimensions. For example, a first aperture may be narrow in width, and a second aperture may be wider in width. Alternatively, the element may comprise a single aperture, and/or the element may be used as a block or shutter.

Optionally, a pneumatic piston may be configured to cause movement of the magnetic actuator. Advantageously, a piston allows for good control of the position and speed of movement of the magnetic actuator.

Advantageously, the chamber is a vacuum chamber of a mass spectrometer. The invention may be used to select, adjust or vary an aperture size by using the adjustment mechanism to control the position of an aperture plate. Beneficially, the described adjustment mechanism can be implemented by use of an actuator arranged outside of a vacuum chamber, thereby rendering unnecessary a vacuum feed-through or sealed connection for any portion of the actuator or adjustment mechanism.

In a second aspect, there is provided a mass spectrometer comprising or including the magnetic adjustment mechanism of any preceding claim.

In a third aspect, there is provided a kit for a magnetic adjustment mechanism comprising an element pivotally connectable inside a chamber, the element comprising a magnetic portion; and a magnetic actuator configurable outside the chamber so as to allow magnetic coupling with the magnetic portion of the element, such that movement of the magnetic actuator causes an adjustment of the position of the element.

Optionally, the kit may comprise a magnetic shielding element configurable between the magnetic portion of the element and the magnetic actuator when the magnetic actuator is in a first location and/or a second location.

LIST OF FIGURES

An adjustment mechanism in accordance with an aspect of the present disclosure is described, by way of example only, with reference to the following drawings, in which.

Figure 3:
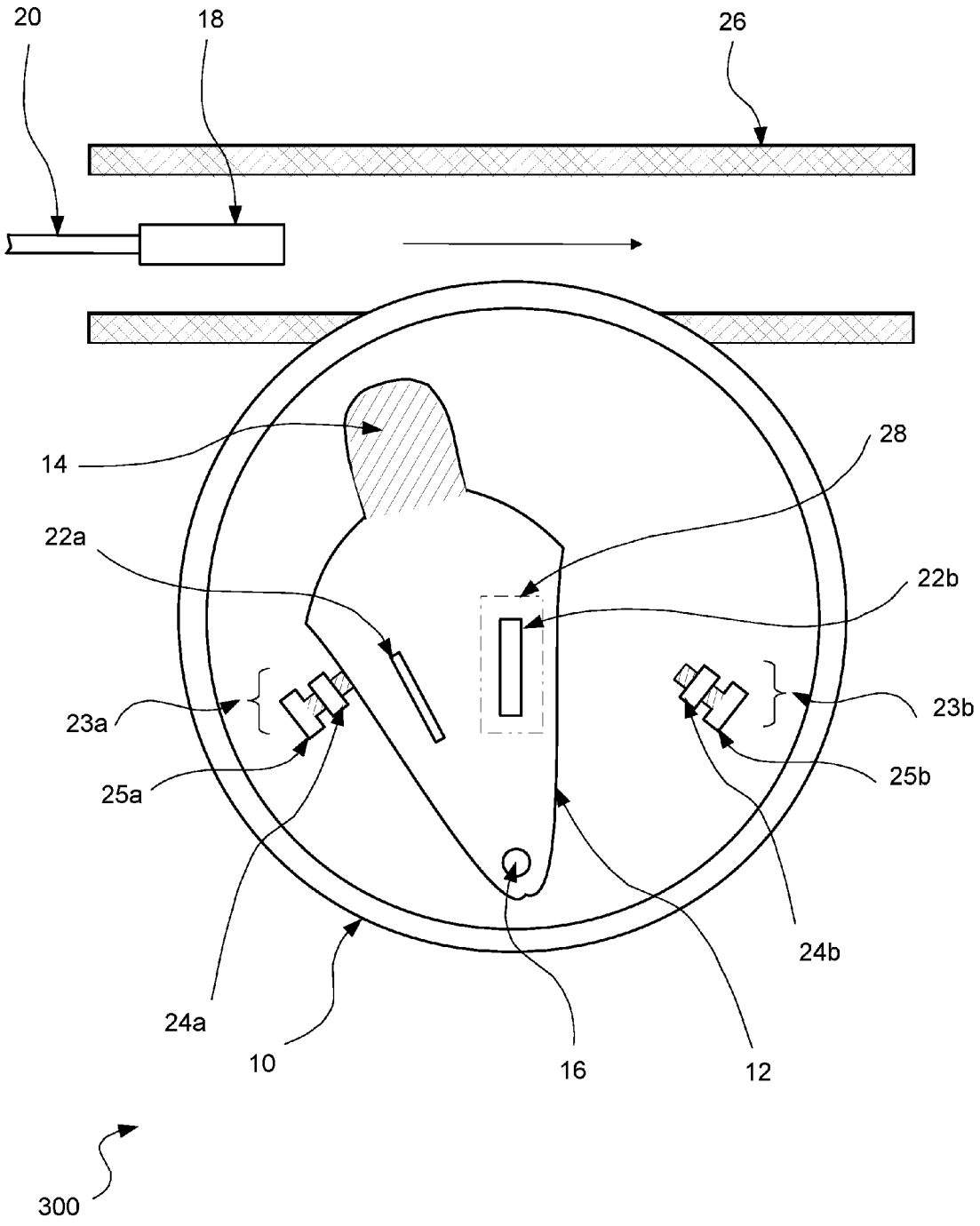
Figure 4:
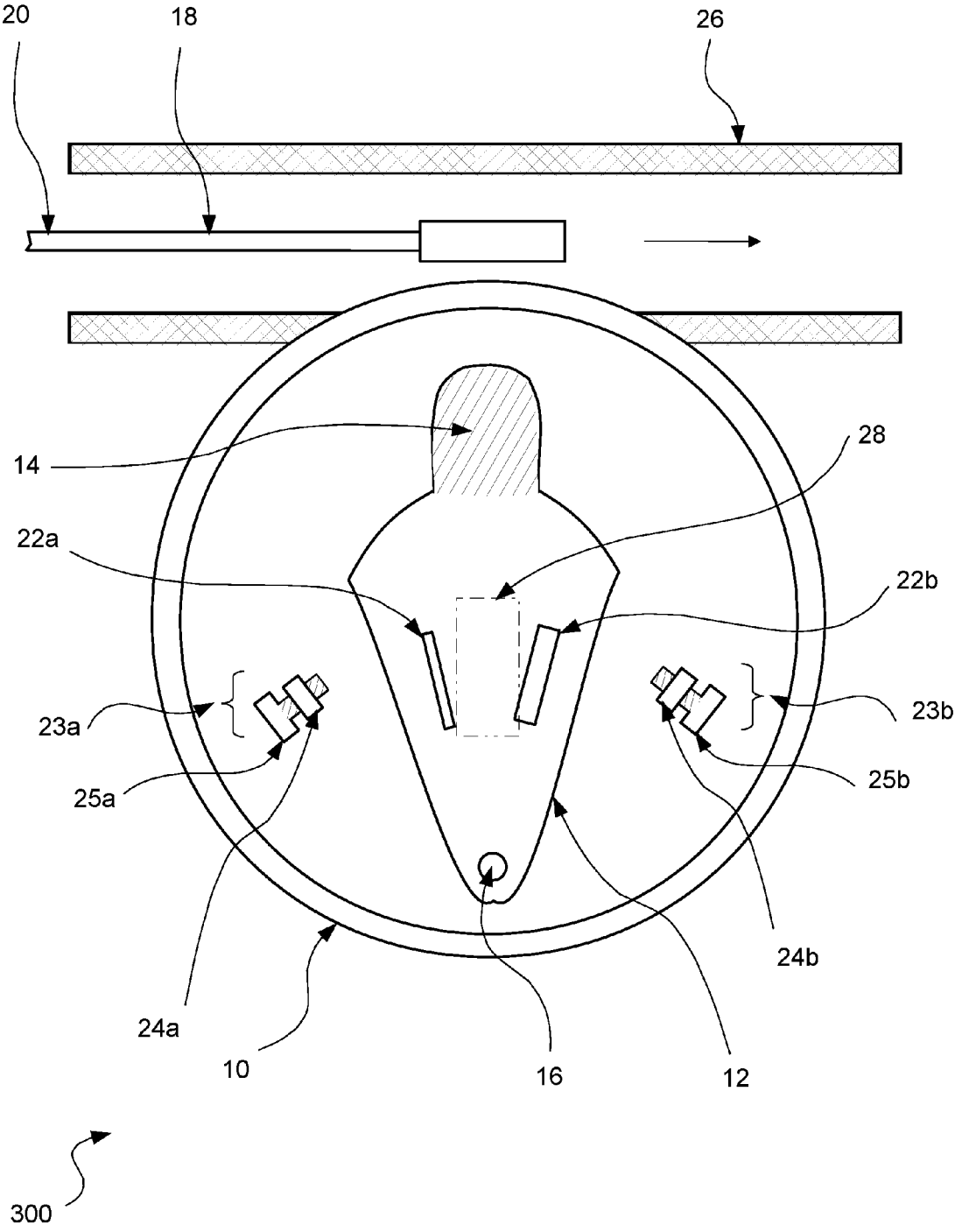
Figure 5:
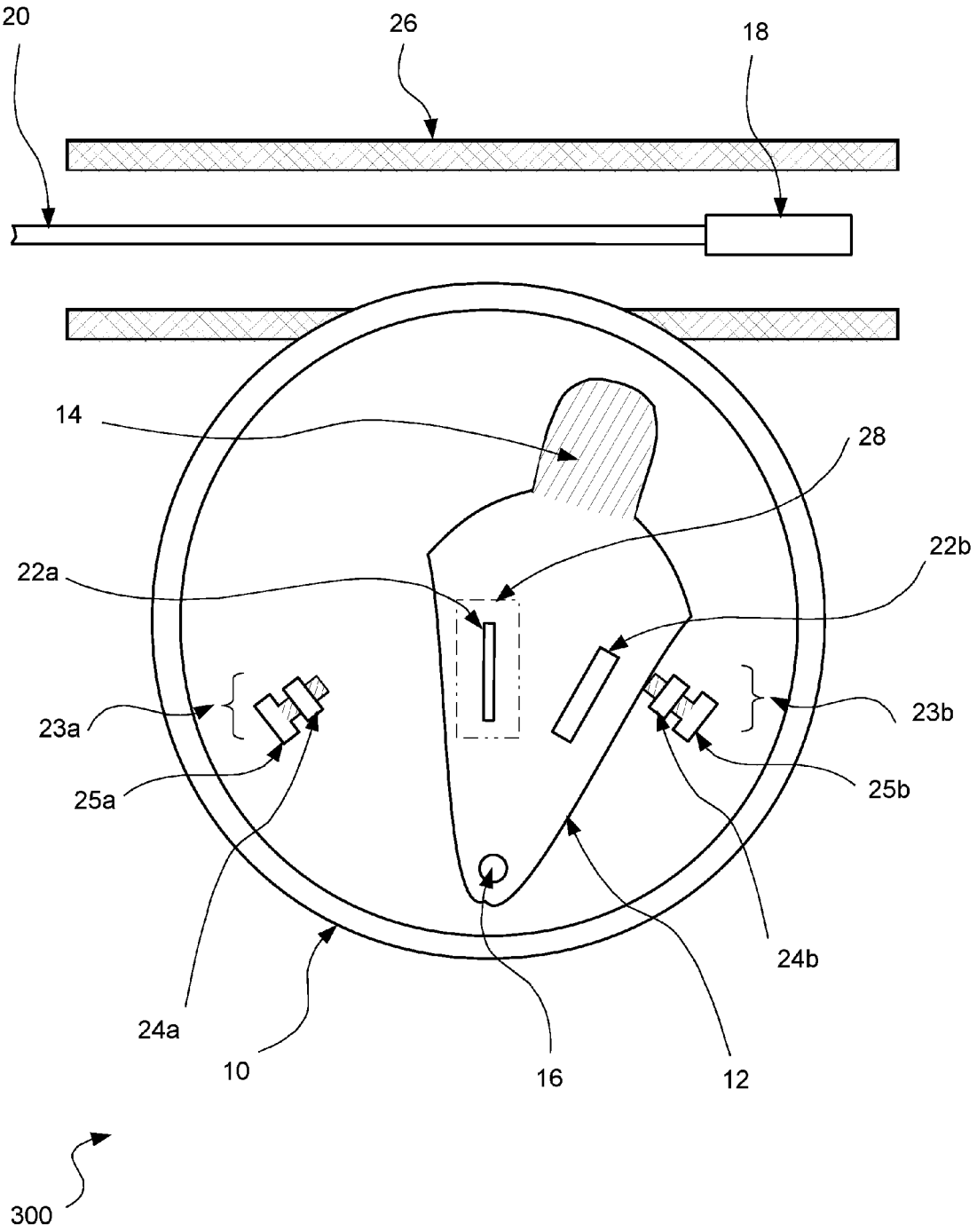

FIG. 3 is a cross-sectional view of a further embodiment of the adjustment mechanism, wherein the element is in the first position; and FIG. 4 is a further cross-sectional view of the embodiment of the adjustment mechanism shown in FIG. 3, wherein the magnetic actuator and the magnetic portion of the element are magnetically coupled; and FIG. 5 is a still further cross-sectional view of the embodiment of the adjustment mechanism shown in FIGS. 3 and 4 wherein the element is in the second position.

Where appropriate, like reference numerals denote like elements in the Figures. The Figures are not to scale.

DETAILED DESCRIPTION OF EMBODIMENTS OF THE INVENTION

Figure 1:
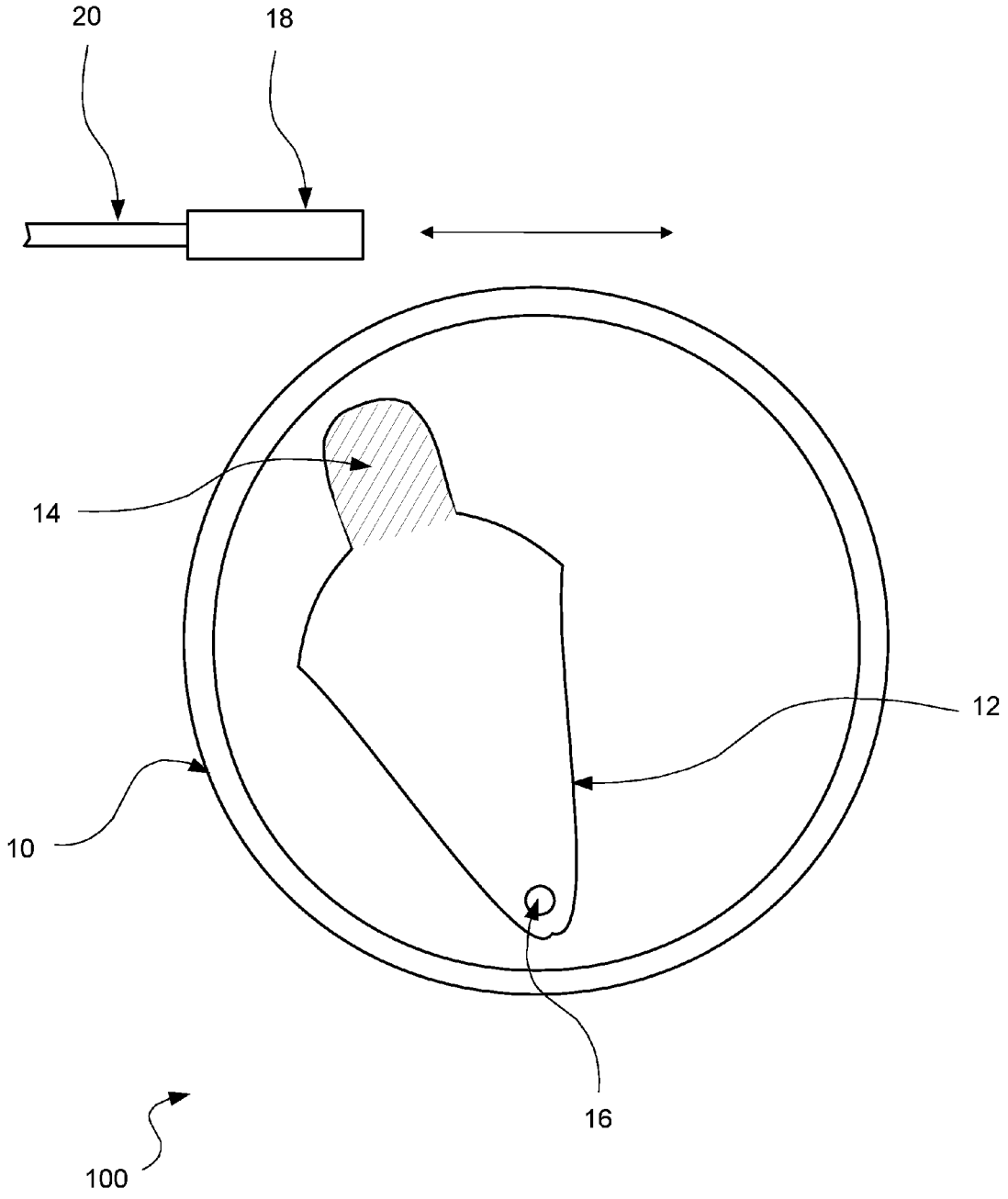
FIG. 1 is a cross-sectional view of an embodiment of the adjustment mechanism.

FIG. 1 shows a magnetic adjustment mechanism 100 which provides adjustment of an element 12 that is disposed within a chamber 10. In the example illustrated in FIG. 1, the chamber 10 is a closed or sealed chamber.

The element 12 is a moveable plate or shutter which is connected to a wall of the chamber at a pivot 16. The element 12 is arranged to rotate around the pivot 16 in a clockwise or anti-clockwise direction. The element 12 acts as a shutter, for example by rotating between a first position where an opening or aperture (not shown) formed within the wall of the chamber 10 is open, and a second position where the aperture is blocked.

The element 12 comprises a magnetic portion 14. In this example, the magnetic portion 14 forms an integral portion of the element 12. Here, the magnetic portion 14 is disposed at the furthest extent of the element 12, spaced away from the pivot 16. The magnetic portion 14 is a temporary magnet. In other words, the magnetic portion 14 is temporarily magnetised when placed in a magnetic field. Here, the material is a "soft" metal.

A magnetic actuator 18 is arranged outside the chamber 10. The magnetic actuator 18 is a permanent magnet. A mechanism for controlling movement of the magnetic actuator 18 provided. Here, the mechanism is a pneumatic piston 20 attached to the magnetic actuator 18 to allow controlled horizontal movement of the magnetic actuator 18.

The magnetic actuator 18 is arranged to be proximate to the magnetic portion 14 of the element 12. The magnetic actuator 18 and the magnetic portion 14 are configured to be attracted to each other, by virtue of their magnetic field. In other words, the magnetic actuator 18 and magnetic portion 14 of the element 12 are arranged so that the magnetic portion 14 resides within the magnetic field of the magnetic actuator.

In use, the magnetic actuator 18 is moved with respect to the chamber, causing the element 12 to be moved. The magnetic interaction between the magnetic actuator 18 and the magnetic portion 14 causes the magnetic portion 14 to be "pulled" or "dragged" in the direction of motion of the magnetic actuator 18. This results in a rotation of the element 12 around the pivot 16. In other words, the attractive magnetic force couples the magnetic portion 14 and element 12 to the motion of the magnetic actuator 18. Referring to the particular example illustrated in FIG. 1, movement of the magnetic actuator 18 from left to right causes the element 12 to rotate in a clockwise direction, and subsequent movement of the magnetic actuator 18 from right to left causes the element 12 to rotate in the anti-clockwise direction.

The element 12 can be held in a required position by correct location of the magnetic actuator 18. For example, the element 12 can be held in an upright position by positioning of the magnetic actuator directly above the pivot 16. In this example, the extent of rotation of the element 10 in the clockwise or anti-clockwise direction is limited by the wall of the chamber 10. For example, if the magnetic actuator 18 is moved far to the left beyond the extent of the chamber 10, the element 12 would move anti-clockwise until the element 12 is positioned or buffered against the wall of the chamber 10. If the magnetic actuator 18 is moved far enough from the chamber 10 that the magnetic actuator 18 and magnetic portion 14 no longer experience magnetic attraction to each other, the element 12 will remain positioned against the wall of the chamber 10 due to the weight of the element 12 and magnetic portion 14.

The magnetic adjustment mechanism described may be particularly beneficial for use within a spectrometer, and more particularly a mass spectrometer.

Figure 2:
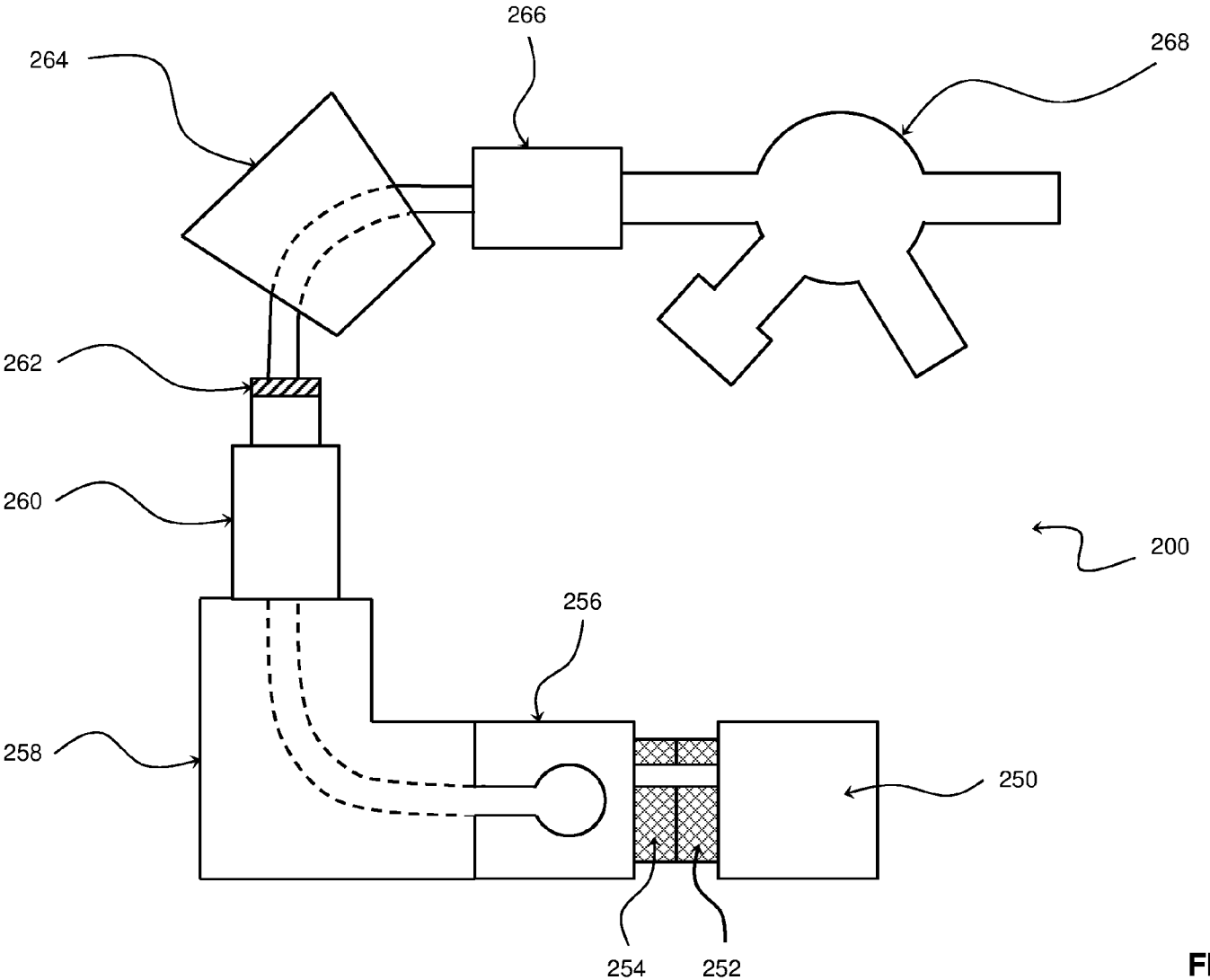
FIG. 2 is a schematic view of a mass spectrometer.

FIG. 2 shows a schematic representation of a double focussing mass spectrometer 200. The ions are generated at the ion source 256 which is powered by power supply 250 connected via connectors 252, 254. The ions are accelerated and passed through the electrostatic analyser (ESA) 258 which assists in focussing the ion beam and selecting ions of the required energy. The ions are next enters a focussing quadrupole 260 to further focus the ion beam. On exiting the focus quadrupole, the ion beam passes through an adjustable aperture plate 262 and then onwards through a magnetic field at the electromagnetic sector 264. The magnetic field separates the ions within the ion beam according to their mass-to-charge ratio. The separated ion beam is subsequently passed through a dispersion quadrupole 266 and then to the detector 268 for analysis.

As described above, the adjustable aperture plate 262 is placed at the exit of the focussing quadrupole 260. The aperture plate 262 can be adjusted to select the size of the aperture through which the ion beam passes. The aperture allows only a portion of the focussed ion beam to pass into the magnetic field. Selection of an aperture having a larger area or wider slit allows a greater portion of the ion beam to pass through into the magnetic field, and so provides a more sensitive measurement. However, a small area or narrower aperture can be useful to reduce ion optical aberrations so delivers improved resolution for the measurement.

In order that the ions within the mass analyser pass through the spectrometer without deflection or adulteration, the passage of the ion beam takes place within a vacuum. As such, the adjustable aperture plate and any mechanism for adjustment must also operate within the vacuum chamber.

The magnetic adjustment mechanism described in the present application can be particularly beneficial for implementing an adjustment of the aperture plate 262 or selection of the aperture of a mass spectrometer. In particular, the magnetic actuator is remote from the adjustable aperture plate and can be arranged outside the vacuum chamber, thereby removing the requirement for any sealed feed-through of any portion of the adjustment mechanism. As a consequence, the described magnetic adjustment mechanism reduces the likelihood of failure or leakage of the vacuum chamber.

FIG. 3 illustrates an embodiment of the magnetic adjustment mechanism implemented to allow selection of an aperture having particular dimensions. In this example, the element 12 is an aperture plate of a mass spectrometer.

The element or aperture plate 12 is arranged in a chamber 10 a vacuum chamber. The element is arranged within the chamber 10 mounted to a wall of the chamber 10 via pivot 16. The element 12 has a magnetic portion 14 at an end of the element. The magnetic portion 14 is disposed at the element 12 opposite and at a distance from the pivot 16.

The magnetic portion 14 is formed of a material which can be temporarily magnetised. This means it will become magnetised when disposed within a magnetic field. However, the magnetic portion 14 will not retain its magnetisation when the magnetic field is removed. In this example, the magnetic portion 14 is a soft metal piece attached to the element. The soft metal piece is comprised of very high purity iron such as ARMCO™ which has 99.8%-99.9% purity.

The element or aperture plate 12 has two apertures or openings 22*a*, 22*b* having different dimensions or widths. The aperture plate is arranged such that a selected aperture (in FIG. 3, the wider aperture 22*b*) is aligned with an opening 28 in the wall of the chamber 10 at which the ion beam enters the chamber 10. The aperture 22*a*, 22*b* which is in alignment with the opening 28 can be selected by rotation of the element or aperture plate 12 around the pivot 16 between a first and second position.

In this example, the first and second position of the element or aperture plate 12 when in alignment with one of the first and second apertures 22*a*, 22*b* is defined by the use of a first and second end stop 23*a*, 23*b*. The end stops 23*a*, 23*b* are configured within the chamber 10 to restrict the rotation of the element 12 around the pivot 16, and to prevent the element 12 moving beyond the first or second position in a clockwise or anti-clockwise direction respectively.

In the embodiment of FIG. 3, the first and second end stop 23*a*, 23*b* each comprise a nut 24*a*, 24*b* which is fixedly connected or integrally formed at the chamber wall. A threaded screw or bolt 25*a*, 25*b* is arranged through the nut 24*a*, 24*b*, such that turning the screw 25*a*, 25*b* causes the screw 25*a*, 25*b* to move into or out of the nut 24*a*, 24*b*. The screw 25*a*, 25*b* and nut 24*a*, 24*b* are arranged such that the element 12 rests against an end of the screw 25*a*, 25*b* when the element 12 is in the first and second position. As such, the first and second position can be adjusted slightly, simply by screwing the screw 25*a*, 25*b* relative to the nut 24*a*, 24*b*. The position of the screw 25*a*, 25*b* may be held in place by using one or two blocking nuts (not shown). Use of a first and second end stop 23*a*, 23*b* in conjunction with the aperture plate 12 ensures precise positioning or alignment of the selected aperture 22*a*, 22*b* with the opening 28 in the chamber wall through which the ion beam is passed. By using adjustable end stops 23*a*, 23*b* as described, the first and second position can be adjusted or modified by small amounts. Therefore, very precise alignment of the apertures 22*a*, 22*b* with the opening 28 in the chamber wall can be achieved.

Movement or rotation of the element 12 around the pivot 16 is realised using a magnetic actuator 18. Advantageously, the magnetic actuator 18 allows the movement of the element 12 to be controlled from outside the chamber 10. The magnetic actuator 18 is arranged in close proximity to the chamber, and particularly in proximity to the magnetic portion 14 of the element 12 within the chamber 10. The actuator 18 is arranged to be moved with respect to the chamber 10, for example from a first location to a second location across the top of the chamber 10 in the direction denoted by an arrow in FIG. 3. The magnetic actuator 18 comprises material which is permanently magnetised, which means it has a persistent magnetic field. In other words, the magnetic actuator 18 is a permanent magnet.

In the example shown in FIG. 3, a magnetic shielding element 26 is arranged to be between the magnetic actuator 18 and the magnetic portion 14 of the element 10 when the element is in the first position or in the second position. In the illustrated example, the magnetic shielding element 26 comprises a soft metal tube which encircles the magnetic actuator 18 at its start and end position (at the extent of the movement of the actuator 18). However, the tubular magnetic shielding element 26 has a gap in the length of the tube between the two end positions, such that the magnetic shielding element 26 is not disposed between the magnetic actuator 18 and the chamber 10 along the full length of the pathway along which the magnetic actuator 18 is moved.

Consequently, when the element or aperture plate 12 is at rest against the first end stop 24*a*, the magnetic shielding element 26 is disposed between the magnetic actuator 18 and the magnetic portion 14. Similarly, if the element 12 is at rest against the second end stop 24*b*, the magnetic shield 26 is arranged to be disposed between the magnetic actuator 18 and the magnetic portion 14 of the element 12. However, for at least some portion of the pathway followed by the magnetic actuator 18 across the top of the chamber 10, no magnetic shielding element 26 is disposed between the magnetic actuator 18 and the magnetic portion 14. As such, the magnetic portion 14 of the element 12 and the magnetic actuator 18 can magnetically interact for the duration of at least some portion of the movement of the actuator 18.

The magnetic shielding element 26 is formed of a material that can be temporarily magnetised. In this example, the magnetic shielding element 26 is comprised of iron. As such, the magnetic shielding element 26 becomes magnetised when the permanent magnet of the magnetic actuator 18 is in close proximity. As a result, the magnetic shield 26 effectively blocks the magnetic field of the magnetic actuator 18 when the magnetic actuator is at the start and end position (at the extent of its movement). Thus, no significant magnetic field extends from the magnetic actuator 18 into the chamber 10 (and towards the magnetic portion 14). Consequently, when the magnetic actuator 18 is shielded by the magnetic shield 26, the magnetic portion 14 of the element 12 is not magnetised. As such, the magnetic shielding element 26 avoids a permanently magnetised element being positioned in the chamber 10. This is particularly advantageous when the magnetic adjustment mechanism is applied within a mass spectrometer, because a permanent magnet may affect the trajectory of the ion beam.

In use, the element or aperture plate 12 may begin at rest against the first end stop 24*a* as shown in FIG. 3. In this configuration, a first aperture 22*a* is selected. The magnetic actuator 18 resides at a first location, with the magnetic shielding element 26 disposed between the magnetic actuator 18 and the magnetic portion 14 of the element 12. As the magnetic shielding element 26 is formed from a material which can be a temporarily magnetised, the magnetic shielding element 26 prevents magnetic field from the magnetic actuator 18 reaching the magnetic portion 14 of the element 12. Therefore, the magnetic portion 14 is not magnetised when the magnetic adjustment mechanism 300 is in this configuration.

When selection of an alternative aperture is required, the magnetic actuator is moved with respect to the chamber in the direction of the arrow shown in FIG. 3 (i.e. from left to right between its start and end position). As the magnetic actuator 18 is moved between its start and end position, the magnetic actuator 18 reaches a location at which the magnetic shielding element 26 is no longer disposed between the magnetic actuator 18 and the magnetic portion 14 of the element 12. As a result, the magnetic portion 14 is exposed to the magnetic field of the magnetic actuator 18. Exposure of the magnetic portion 14 to a magnetic field causes the magnetic portion 14 to become magnetised. The resultant magnetic interaction or magnetic attraction between the magnetic actuator 18 and the magnetic portion 14 causes the parts to become magnetically coupled. As such, further movement of the magnetic actuator 18 drags or tows the magnetic portion 14 and causes rotation of the element 12 around the pivot 16.

FIG. 4 shows the configuration of the magnetic adjustment mechanism 300 when the magnetic actuator 18 is moved further across the top of the chamber 10. In this configuration, the magnetic actuator 18 and magnetic portion 14 of the element 12 are magnetically coupled. Movement of the magnetic actuator 18 has pulled or towed the magnetic portion 14 such that the magnetic element 12 has been rotated around the pivot 16.

FIG. 5 shows the configuration of the magnetic adjustment mechanism 300 when the magnetic actuator 18 has been moved to the opposite side of the chamber 18 to its end position, at its furthest extent from its starting position. Here, the magnetic shielding element 26 is again disposed between the magnetic portion 14 of the element 12 and the magnetic actuator 18. As such, the magnetic field of the magnetic actuator 18 does not extend to the magnetic portion 14, and the magnetic portion 14 is no longer magnetised. No magnetic field persists in the magnetic portion 14 of the element 12, because the magnetic portion 14 is a temporary magnetic material. In this configuration, the magnetic actuator 18 and the magnetic portion 14 do not experience a magnetic interaction.

Once the magnetic coupling between the magnetic actuator 18 and the magnetic portion 14 has ceased, the weight of the element or aperture plate 12 causes the element to rotate around the pivot 16 to the furthest extent allowed. In the example illustrated at FIG. 5, the element 12 rests against second end stop 24*b* which prevents any further rotation. When the element or aperture plate 12 rests against the second end stop 24*b*, the second aperture 22*b* of the aperture plate 12 is aligned with the opening in the chamber wall 28. As such, selection of the aperture has been accomplished.

A switch back to the first aperture 22*a*, may be simply achieved by movement of the magnetic actuator 18 in the opposite direction (right to left, or from its end position back to its starting position). Thus, the element 12 is rotated in the opposite direction in the same manner as before.

Various modifications will be apparent to those skilled the art.

For example, the chamber 10 may or may not be sealed. The chamber 10 may contain a vacuum, or be pressurised above or below atmospheric pressure.

The element 12 may not be a plate, but instead may be another form of lever or moveable or switchable element.

The magnetic portion 14 of the element 12 may be integral, or may be a magnetic piece that is attached to the element 12. Furthermore, the magnetic portion 14 need not be positioned at the extent of the element 12 furthest from the pivot 16. It may be positioned at other regions of the element 12 and still function in the manner previously described.

The magnetic portion may be formed of a ferromagnetic material. The magnetic portion may be a temporary magnet (being a material that is magnetised when placed in a magnetic field) or may be a permanent magnet (being formed of a material that is permanently magnetised.

In the described examples, the element is shown pivotally mounted to a wall of the chamber. Instead, the element could be pivotally mounted to a frame or other mounting within the chamber.

The magnetic actuator 18 can be attached to a pneumatic piston. However, other mechanisms for adjustment of the position of the magnetic actuator 18 may be used. For example, the magnetic actuator 18 may be attached to a screw thread or another arrangement allowing the magnetic actuator to be moved by the operator.

Although the magnetic actuator in the described examples is described as moving horizontally above the chamber, the skilled person will appreciate that arrangement of the actuator to move in another arrangement relative to the chamber. For example, the magnetic actuator does not need to be arranged above the chamber, but could be positioned to move at the side of the chamber. The magnetic actuator could be arranged to move circumferentially around the chamber.

The magnetic shielding element in the described example is a soft metal tube which encircles the magnetic actuator when it is at its start and end position. However, the magnetic shield may be any shape that provides a barrier between the magnetic actuator and the magnetic portion, and thereby prevents magnetisation of the magnetic portion. For example, the shield may be a flat sheet or a curved sheet that partially surrounds, but does not fully encircle, the actuator. However, the shielding may be optimised by using soft metal tube portions which encircle or enclose the actuator.

The first and second end stops discussed above in relation to FIGS. 3, 4 and 5 comprise a threaded screw and nut in order to provide an adjustable end stop. However, the end stops may be studs or protrusions arranged at the wall of the chamber, or another type of stop or barricade which blocks or restricts rotation of the element around the pivot.

The invention claimed is:

1. A magnetic adjustment mechanism, comprising:

a chamber, the chamber being a vacuum chamber of a mass spectrometer;

an element comprising a magnetic portion, the element pivotally mounted within the chamber;

a magnetic actuator arranged outside the chamber to allow magnetic coupling with the magnetic portion of the element, such that movement of the magnetic actuator causes an adjustment of the position of the element.

2. The magnetic adjustment mechanism of claim 1, wherein the chamber is a pressure chamber.

3. The magnetic adjustment mechanism of claim 1, wherein the magnetic portion comprises a material that can be temporarily magnetised.

4. The magnetic adjustment mechanism of claim 1, wherein the magnetic portion is confined to a region of the element.

5. The magnetic adjustment mechanism of claim 1, wherein the magnetic portion is confined to a region of the element positioned distal from the pivotable mount.

6. The magnetic adjustment mechanism of claim 1, wherein the movement of the magnetic actuator between a first and a second location causes the position of the element to be adjusted between a first position and a second position.

7. The magnetic adjustment mechanism of claim 6, further comprising a first and a second end stop arranged to restrict the extent of adjustment of the element, the first and second end stop arranged to permit adjustment of the element only between the first and second position.

8. The magnetic adjustment mechanism of claim 1, wherein the element comprises a plate having one or more apertures and wherein adjustment of the position of the element results in selection of an aperture.

9. The magnetic adjustment mechanism of claim 8, wherein the one or more apertures have different dimensions.

10. The magnetic adjustment mechanism of claim 1, wherein the adjustment of the position of the element causes movement of a component of the mass spectrometer in relation to an ion beam path in the vacuum chamber.

11. A mass spectrometer comprising or including the magnetic adjustment mechanism of claim 1.

12. A magnetic adjustment mechanism, comprising:

a chamber, the chamber being a vacuum chamber of a mass spectrometer;

an element comprising a magnetic portion, the element pivotally mounted within the chamber;

a magnetic actuator arranged outside the chamber to allow magnetic coupling with the magnetic portion of the element, such that movement of the magnetic actuator causes an adjustment of the position of the element, wherein the movement of the magnetic actuator between a first and a second location causes the position of the element to be adjusted between a first position and a second position; and a magnetic shielding element arranged between the magnetic portion of the element and the magnetic actuator when the magnetic actuator is the first location and/or arranged between the magnetic portion of the element and the magnetic actuator when the magnetic actuator is in the second location.

13. The magnetic adjustment mechanism of claim 12, wherein the magnetic shielding element is arranged to at least partially surround the magnetic actuator when the magnetic actuator is in the first position and/or in the second position.

14. The magnetic adjustment mechanism of claim 12, wherein the magnetic shielding element is arranged to enclose the magnetic actuator when the magnetic shielding element is in the first position and/or in the second position.

15. The magnetic adjustment mechanism of claim 12, wherein the magnetic shielding element is formed of a material which can be temporarily magnetised.

16. A magnetic adjustment mechanism, comprising:

a chamber, the chamber being a vacuum chamber of a mass spectrometer;

an element comprising a magnetic portion, the element pivotally mounted within the chamber;

a magnetic actuator arranged outside the chamber to allow magnetic coupling with the magnetic portion of the element, such that movement of the magnetic actuator causes an adjustment of the position of the element; and a pneumatic piston configured to move the magnetic actuator.

* * * * *